US007116232B2

(12) United States Patent
Below et al.

(10) Patent No.: US 7,116,232 B2
(45) Date of Patent: Oct. 3, 2006

(54) TRANSPONDER HOLDER

(75) Inventors: Armin Below, Kaufering (DE); Markus Hartmann, Mauerstetten (DE); Stefan Zamel, Meiningen (AT)

(73) Assignee: Hilti Aktiengesellscahft, Schhan (LI)

( * ) Notice: Subject to any disclaimer, the term of this patent is extended or adjusted under 35 U.S.C. 154(b) by 0 days.

(21) Appl. No.: 10/739,864

(22) Filed: Dec. 18, 2003

(65) Prior Publication Data

US 2004/0135692 A1 Jul. 15, 2004

(30) Foreign Application Priority Data

Dec. 23, 2002 (DE) ..... 102 60 706

(51) Int. Cl.
*G08B 13/14* (2006.01)

(52) U.S. Cl. ..... 340/572.8; 340/572.9

(58) Field of Classification Search ..... 340/572.8, 340/572.1, 568.1; 30/392, 514
See application file for complete search history.

(56) References Cited

U.S. PATENT DOCUMENTS 3,952,239 A * 4/1976 Owings et al. ..... 320/113
4,742,470 A * 5/1988 Juengel ..... 700/175
D307,098 S * 4/1990 Clivio ..... D8/8
D365,256 S * 12/1995 Griffin et al. ..... D8/8
5,992,663 A * 11/1999 Mitchell ..... 220/4.21
6,191,691 B1 * 2/2001 Serrault ..... 340/572.8
6,201,474 B1 * 3/2001 Brady et al. ..... 340/572.8
6,234,051 B1 * 5/2001 Bareggi ..... 81/479
6,553,642 B1 * 4/2003 Driessen ..... 29/453
6,786,683 B1 * 9/2004 Schaer et al. ..... 408/16
6,816,083 B1 * 11/2004 Brandt ..... 340/870.11
6,839,934 B1 * 1/2005 Houghton et al. ..... 15/329
6,875,040 B1 * 4/2005 O'Keefe et al. ..... 439/346
2002/0126010 A1 * 9/2002 Trimble et al. ..... 340/568.1
2003/0008722 A1 * 1/2003 Konow ..... 473/223
2003/0102970 A1 * 6/2003 Creel et al. ..... 340/568.1
2004/0066295 A1 * 4/2004 Fellenstein et al. ..... 340/568.1
2004/0092991 A1 * 5/2004 Deng ..... 606/170
2004/0108120 A1 * 6/2004 Wiesner et al. ..... 173/2
2004/0187321 A1 * 9/2004 Hartmann et al. ..... 30/377
2004/0187323 A1 * 9/2004 Hartmann ..... 30/392
2004/0200078 A1 * 10/2004 Hartmann ..... 30/392
2005/0259943 A1 * 11/2005 Braun et al. ..... 385/147

* cited by examiner

*Primary Examiner*—Jeffery Hofsass
*Assistant Examiner*—Anne V. Lai
(74) *Attorney, Agent, or Firm*—Abelman, Frayne & Schwab

(57) ABSTRACT

A holder (20*a*, 20*b*) is provided on a portable tool (2) having a housing (4), in which a transponder (26*a*, 26*b*) can be accommodated, which is a in particular part of an anti-theft system. The holder (20*a*, 20*b*) is, in the final assembled condition, delimited by an outer wall (18) of the housing (4) and at least on other structural element (16) of the tool (2), which after final assembly is applied to the outer wall (18).

6 Claims, 2 Drawing Sheets

TRANSPONDER HOLDER

FIELD OF THE INVENTION

The invention relates to a portable tool with a housing, on which a holder is arranged, and in which a transponder can be accommodated, which is a part of an anti-theft system.

DESCRIPTION OF THE PRIOR ART

Transponder systems have been used for some time in the widest range of applications for anti-theft protection. Accordingly, valuable articles for sale, such as electrical tools, in particular saws, such as saber saws, compass saws or circular saws, hi-fi equipment or articles of clothing are securely connected with a transponder, which can be activated by an induction field. In the activated state, the transponder sends signals to a receiver for transmission of data or for triggering an alarm.

U.S. Pat. No. 6,234,051 discloses a power-driven tightening tool with each of the screw elements having a recess with a transponder inserted therein. It is possible for each screw insert to calculate specific parameters relevant to operation such as torque, tightening angle or the like using data that is emitted from the transponder. The transponder is held in the recess by the inner wall of the tightener housing inside the tightening tool and is replaced at the time of every change of insert with the screw insert.

Transponders that are a component of an anti-theft system must, however, be connected with the respective article such that they can be removed only with a destructive effect or with considerable effort. In addition, they must be a certain distance from metal parts of barcodes to avoid misoperation.

For example, it is known, to apply stickers on the inside of tool housings prior to final assembly, in which a transponder is integrated. After final assembly, access cannot be gained to the transponder or the transponder can be accessed only with considerable effort. Such a transponder can be activated by an induction field for triggering a theft alarm.

In such transponder stickers, however, there is the risk that the trigger occurs prior to sale of the machine and as a result, burst so that it can no longer be activated. Furthermore, such transponder stickers come away from the housing because of the temperatures and vibrations that occur during operation. There is the risk that the loose sticker accesses a rotary drive or drive part on the inside of the tool and can cause noise or even damage.

SUMMARY OF THE INVENTION

The object of the present invention is to prevent the aforementioned drawbacks in a portable tool having a transponder and to simplify the attachment of the transponder to the tool.

According to the invention, this object is achieved, in that the holder in the end-mounted condition is formed by an external side of the housing and at least one further structural component of the tool, which after final assembly is fastened to the external side.

Using this arrangement, it is possible to separate the transponder by means of the housing from the inside of the tool. Accordingly, on the one hand, misoperation because of the proximity of the transponder to metal parts is prevented. On the other hand, there is no risk that a loose transponder can find its way between moving drive or gear parts. In addition, the transponder is affixed securely and permanently on the tool with this procedure. Accordingly, the transponder holder is formed solely by already existing elements. In this way, the costs of manufacture are kept low. The additional structural element can be formed by additional protective, insulating, operating or mounting elements, which are permanently affixed to the housing at the time of final assembly. It is also conceivable that the housing be configured in several parts and has an overlapping zone, in which an overlapping part of the housing part is adjacent to the external side of another housing part. The holder for the transponder would then be arranged in the overlapping zone and would be delimited by the two housing parts.

It is advantageous that the additional structural element consists of a grip element. Such grip elements are generally made of a softer material than the material of the tool housing and should allow a secure and comfortable hold of the tool during operation. In addition, grip elements in motor-driven tools are frequently used simultaneously as hand protection. Accordingly, the grip elements are formed such that they cover areas of the housing that heat up during operation and could be contacted by the operator. Such grip elements with a simultaneous hand protection function are, in the case of saber saws, configured such that they at least substantially enclose the machine neck, which is also used for holding the machine. The grip elements consequently lie over relatively large zones on the housing and accordingly offer numerous possibilities for accommodating the transponder holder.

It is also advantageous that the holder has a cross-section, whose width widens continuously in the direction of a holder opening. Using this trough-shaped form for the holder, it can be manufactured particularly easily in a casting process or by subsequent working.

It is particularly advantageous that the holder is formed by a recess in the housing, in which a fastener element of the other structural element, in the end-mounted condition, engages An already existing recess can be used as the transponder holder when this is done. As a result, only minor changes must be made, if at all, on the housing such as the enlargement of a receptacle for a fastener to enable the housing to also accommodate the transponder.

It is advantageous if the fastener element has a deformable rib, which is formed on the other structural element. By corresponding dimensioning of the rib vis-à-vis the recess, it is possible to secure the transponder form in a simplified fashion or even force lockingly in the recess. In this fashion, unnecessary noise production during operation caused by the transponder can be prevented.

It is advantageous if the holder is formed by a recess on the outer wall, in which the transponder can be completely accommodated and which can be closed by the application of an inner surface of the other structural element. In this instance, completely accommodated means that the transponder installed in the recess does not protrude out of the recess. In this fashion, no change at all must be made to the other structural element used to close the opening of the recess, whereby the securing of the transponder on the tool housing is further simplified.

In the alternative hereto, it is advantageous that the holder is formed by a recess in the other structural element, in which the transponder can be completely accommodated and which can be closed by the cover on the outside of the housing. In this fashion, it is possible to secure the transponder at the time of final assembly without additonal working of the housing. Moreover, the transponder is positioned completely inside the other structural element, whereby the holder in the end-mounted condition is closed by the housing. Because the other structural elements are frequently made of soft material and further have a certain thickness, there is also the possibility of forming the holder even at a later point in time.

BRIEF DESCRIPTION OF THE DRAWINGS

The exemplary embodiments of the invention will be more completely described with reference to the drawings, wherein.

DETAILED DESCRIPTION OF THE PREFERRED EMBODIMENT

Figure 1:
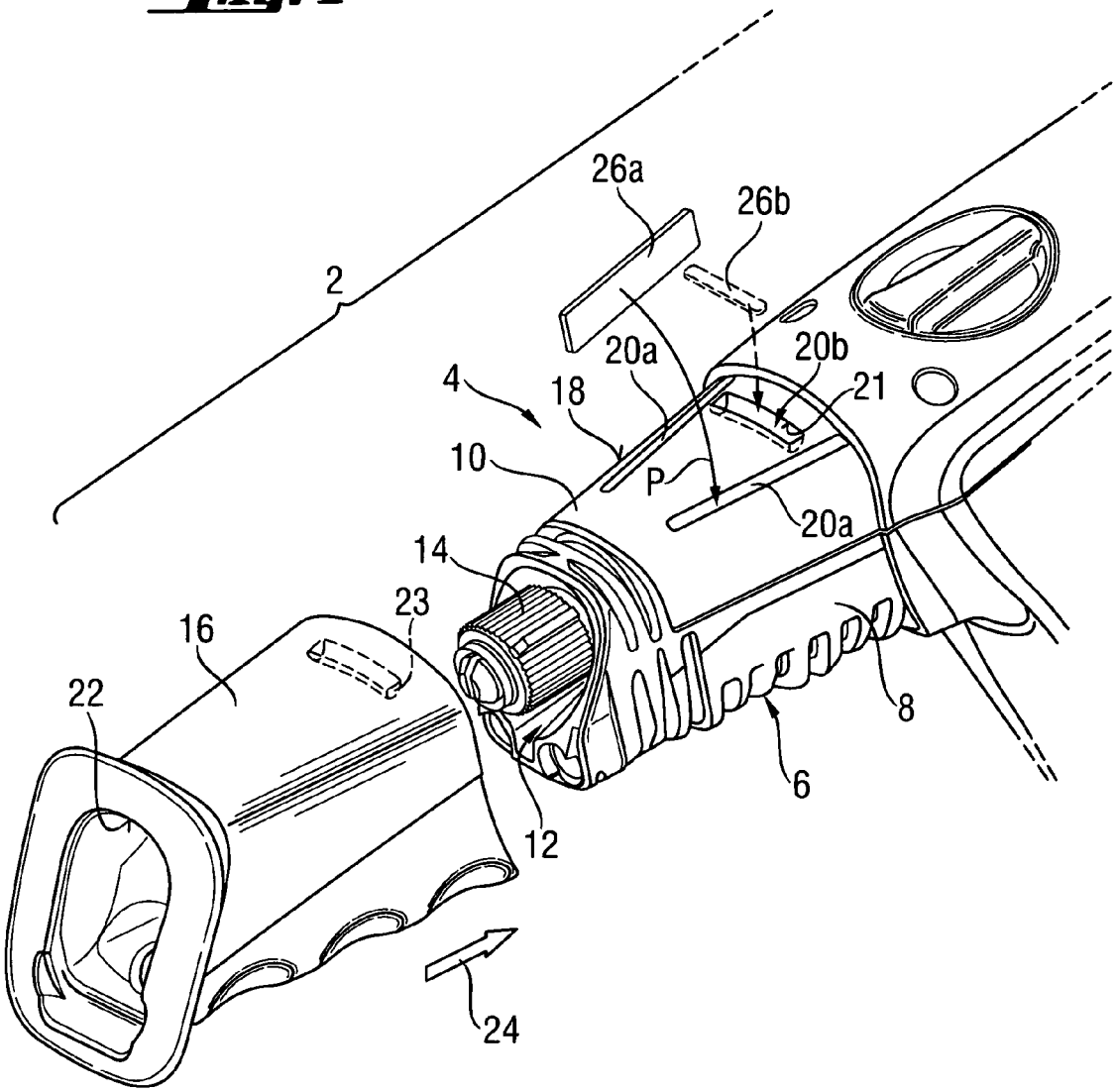
FIG. 1: shows a perspective view of the front part of a tool according to the invention before its final assembly.
Figure 2:
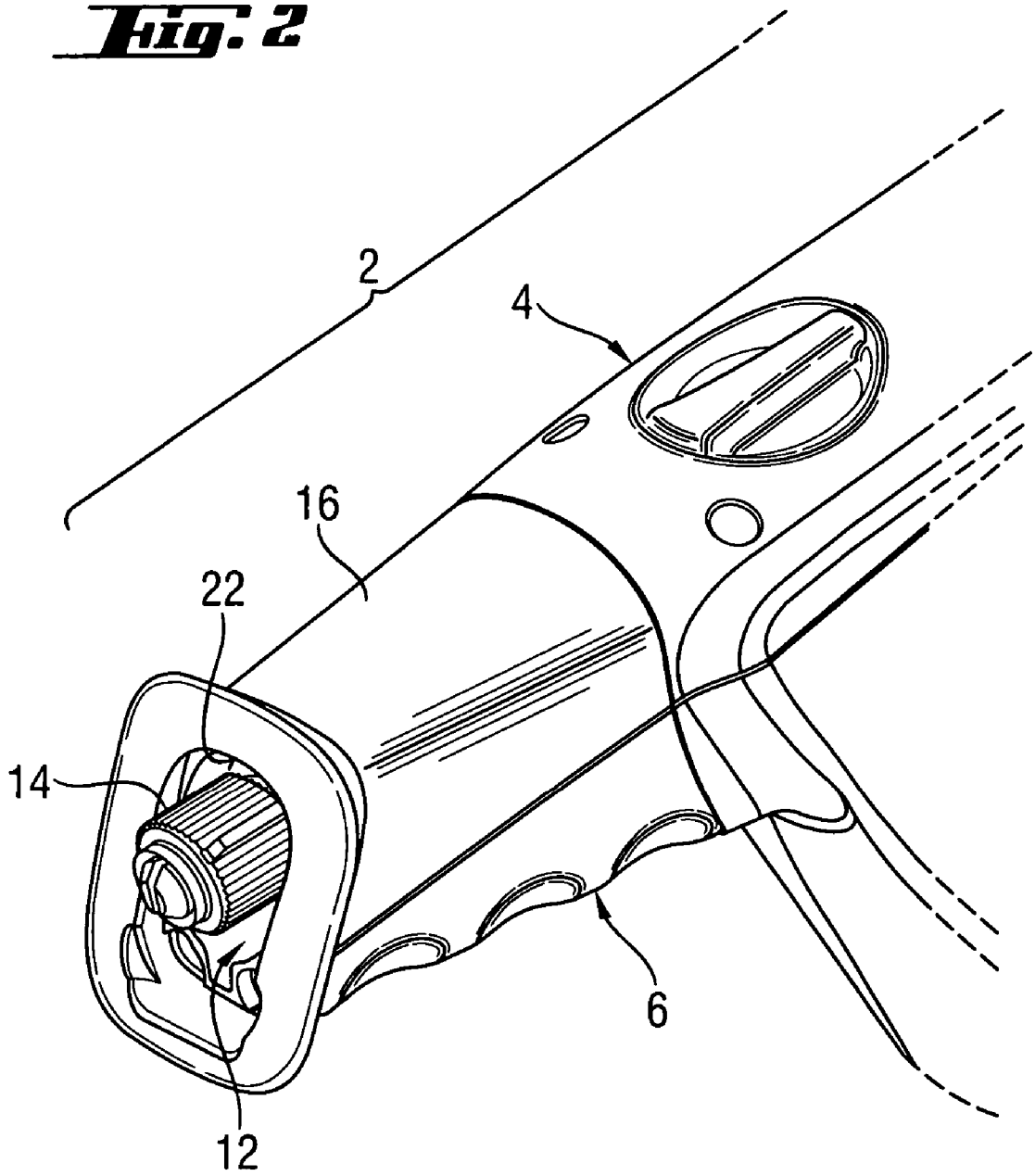
FIG. 2: shows a perspective view of the front part of a tool according to FIG. 1 after final assembly of same.

FIGS. 1 and 2 represent the front part of a tool 2 according to the invention in the form of a saber saw with a housing 4. The housing 4 is configured of multiple parts and has a gearbox 8 with a housing cover 10 in the zone of a machine neck 6. A tool holder 14 projects from a front opening 12 of the housing 4.

FIG. 1 shows the tool 2 before its final assembly with a separated wide structural element 16 of the tool 2 in the form of a substantially sleeve-shaped grip element. The housing cover 10 has holders 20*a*, 20*b*, in the form of slit or trough-shaped recesses, on its external 18, which have a cross-section whose width continuously widens in the direction of the holder opening 21.

A deformable rib 23 is formed (shown in broken lines) on an inner wall 22 of the other structural element 16. In the final assembly, the other structural element 16 is pushed up in the assembly direction 24 over the tool holder 14 onto the gearbox 8 and the housing cover 10. Accordingly, the deformable rib 23 engages with the holder 20*b*. When this is done, the structural element 16 is connected form or force lockingly with the housing cover 10 of the housing 4. FIG. 2 shows the front part of the tool 2 according to the invention in the final assembled condition with the mounted grip element 16 on the machine neck 6.

A transponder 26*a* is installed in one of the holders 20*a* to safeguard the tool 2 against theft, before final assembly, as indicated by the arrow P. When this is done, the holder is dimensioned such that it can completely accommodate the transponder 26*a*.

Two holders 20*a* for the transponder are configured alongside the holder 20*b* for the rib 23 to make it possible to more easily manufacture and to prevent an uneven distortion of the housing cover 10, in the tool 2 represented here. Equally expedient, it is possible to form only one holder 20*a* or an even larger number of holders 20*a*

In the alternative hereto, as shown in dashed lines, it is also possible to house a transponder 26*b* in the holder 20*b*, that co-operates with the rib 23. The holder 20*b* is then dimensioned such that it can accommodate both the transponder 26*b* and the rib 23 of the structural element 16. If the rib 23 in final assembly is now urged into the holder 20*b*, on the one hand, the structural element 16 is permanently secured on the housing 4 and at the same time the transponder 26*b* is firmly pressed into the holder 20*b*.

In both alternative embodiments, after final assembly of the respective transponder 26*a*, 26*b* it is fixed permanently and inaccessibly from the outside to the tool 2. The position of the transponder 26*a*, 26*b* is accordingly selected such that with a planned stowing of the tool 2 in a tool box (not shown), the transponder 26*a*, 26*b* has an adequate separation from metal objects or barcodes, in order to appreciably exclude any functional interference with the transponder 26*a*, 26*b*.

As soon as the transponder 26*a*, 26*b* is brought, for example in an event of theft of the tool 2, into an induction field, it is activated and transmits a signal to a receiver device of an alarm device. The alarm is triggered by the signal and accordingly warns of a theft.

What is claimed is:

1. A portable tool having a housing whereon a holder is provided and wherein a transponder (26*a*) is accommodated to be a component of an anti-theft system, wherein the holder (20*a*, 20*b*) in the final assembled condition is delimited by an outer wall (18) of the housing (4) and at least one other structural element (16) of the tool (2) that is permanently attached after final assembly over the outer wall (18) for securing the transponder (26*a*) in the holder (20*a*, 20*b*), wherein the other structural element (16) is formed by a grip element.

2. A portable tool having a housing whereon a holder is provided and wherein a transponder (26*a*) is accommodated to be a component of an anti-theft system, wherein the holder (20*a*, 20*b*) in the final assembled condition is delimited by an outer wall (18) of the housing (4) and at least one other structural element (16) of the tool (2) that is attached after final assembly over the outer wall (18), wherein the holder (20*a*, 20*b*) has a cross-section with a width continuously increasing in the direction of a holder opening (21).

3. The portable tool of claim 2, wherein the holder (20*b*) is formed by a recess on the outer wall (18) of the housing (4), and wherein, in the final assembled condition, a fastener of the other structural element (16) engage in the recess.

4. The portable tool of claim 3, wherein the fastener has a deformable rib (23) that is formed on the other structural element (16).

5. The portable tool of claim 2, wherein the holder (20*a*) is formed by a recess on the outer side (18) and the transponder (26*a*) can be completely accommodated in the recess and wherein the recess can be closed by an inner surface (22) of the other structural element (16).

6. The portable tool of claim 2, wherein the holder (20*a*) is formed by an recess in the other structural element (16) and the transponder (26*a*) can be completely accommodated in the recess and wherein the recess can be closed by the outer wall (18) of housing (4).

* * * * *